US010156124B2

(12) United States Patent
Guzman et al.

(10) Patent No.: US 10,156,124 B2
(45) Date of Patent: Dec. 18, 2018

(54) BALANCED PISTON TOE SLEEVE

(71) Applicant: TAM INTERNATIONAL, INC., Houston, TX (US)

(72) Inventors: Jessica Guzman, Houston, TX (US); Ray Frisby, Houston, TX (US); Caleb Kelley, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 218 days.

(21) Appl. No.: 15/001,800

(22) Filed: Jan. 20, 2016

(65) Prior Publication Data

US 2016/0208578 A1 Jul. 21, 2016

Related U.S. Application Data

(60) Provisional application No. 62/105,607, filed on Jan. 20, 2015.

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/14* (2013.01); *E21B 34/10* (2013.01); *E21B 2034/007* (2013.01)

(58) Field of Classification Search

CPC ..... E21B 34/10; E21B 34/14; E21B 2034/007
See application file for complete search history.

(56) References Cited

U.S. PATENT DOCUMENTS

| | | | | |
|---|---|---|---|---|
| 4,557,333 | A | 12/1985 | Beck | |
| 5,024,273 | A * | 6/1991 | Coone | E21B 33/127 166/154 |
| 5,597,016 | A | 1/1997 | Manke et al. | |
| 7,284,619 | B2 | 10/2007 | Stokley et al. | |
| 8,720,561 | B2 | 5/2014 | Zhou | |
| 8,757,265 | B1 | 6/2014 | Cuffe et al. | |
| 9,359,864 | B2 * | 6/2016 | Harris | E21B 34/101 |
| 9,500,063 | B2 * | 11/2016 | Greenan | E21B 34/102 |
| 9,926,768 | B2 | 3/2018 | Dinkel | |
| 2010/0314562 | A1 * | 12/2010 | Bisset | E21B 34/06 251/12 |
| 2012/0279723 | A1 * | 11/2012 | Hofman | E21B 34/063 166/373 |

OTHER PUBLICATIONS

International Search Report and Written Opinion issued in International Patent Application No. PCT/US2016/014090, dated Jul. 1, 2016 (7 pages).

* cited by examiner

*Primary Examiner* — Matthew R Buck
(74) *Attorney, Agent, or Firm* — Adolph Locklar

(57) ABSTRACT

A balanced piston toe sleeve allows a pressure test cycle to be carried out before opening the bore of the toe sleeve to the wellbore. The balanced piston toe sleeve includes a valve assembly in which a valve piston separates a valve cylinder into a balancing cylinder and an actuation cylinder. The actuation cylinder is coupled to the bore through a check valve which allows unidirectional flow into the actuation cylinder. The balancing cylinder is in fluid communication with the bore. After a pressure test cycle, the pressure in the balancing cylinder reduces, while the pressure in the actuation cylinder is retained by the check valve. The valve piston shifts into the open position, allowing fluid flow from the bore to the toe sleeve.

18 Claims, 7 Drawing Sheets

BALANCED PISTON TOE SLEEVE

CROSS-REFERENCE TO RELATED APPLICATIONS

This application is a nonprovisional application which claims priority from U.S. provisional application No. 62/105,607, filed Jan. 20, 2015.

TECHNICAL FIELD/FIELD OF THE DISCLOSURE

The present disclosure relates to downhole tools for providing a communication path from the inside of an inner tubular to the annular area between the inner tubular and an outer tubular or an uncased borehole wall, for stimulation or production.

BACKGROUND OF THE DISCLOSURE

Fracturing sleeves are common devices used in a downhole wellbore to provide a flow path for stimulation or other fluids from inside the completion string or tubular to the formation outside the tubular and/or to allow production of well fluids from the formation into the tubular. Typically fracturing sleeves are either ball actuated, RFID actuated, or pressure-actuated.

SUMMARY

The present disclosure provides for a valve assembly for a pressure actuated downhole tool. The valve assembly may include a valve collar. The valve collar may include a valve cylinder formed in a wall of the valve collar. The valve cylinder may be coupled to the bore of the valve collar by a balancing port and a test port. The test port may include a check valve and an output port. The valve collar may include a valve piston positioned within the valve cylinder between the balancing port and the test port. The valve piston may fluidly seal to the valve cylinder and may divide the valve cylinder into a balancing cylinder in fluid communication with the balancing port and an actuating cylinder in fluid communication with the test port.

The present disclosure also provides for a balanced piston toe sleeve. The balanced piston toe sleeve may include a valve collar. The valve collar may include a valve cylinder formed in a wall of the valve collar. The valve cylinder may be coupled to the bore of the valve collar by a balancing port and a test port. The test port may include a check valve and an output port. The valve collar may include a valve piston positioned within the valve cylinder between the balancing port and the test port. The valve piston may fluidly seal to the valve cylinder and may divide the valve cylinder into a balancing cylinder in fluid communication with the balancing port and an actuating cylinder in fluid communication with the test port. The balanced piston toe sleeve may include a generally tubular mandrel coupled to the valve collar forming a continuous fluidly connected bore. The mandrel may include an aperture from its interior to its exterior. The balanced piston toe sleeve may include a generally tubular port housing coupled to the valve collar. The port housing may define an opening cylinder between an inner wall of the port housing and the exterior cylindrical surface of the mandrel. The opening cylinder may be fluidly coupled to the opening port of the valve collar. The port housing may include an aperture from its interior to the surrounding wellbore positioned to substantially align with the aperture of the mandrel. The balanced piston toe sleeve may include an opening piston positioned to slide within the opening cylinder in response to fluid pressure within the opening cylinder when fluid pressure is introduced therein via the opening port of the valve collar. The opening piston may include at least one piston aperture.

The present disclosure also provides for a method. The method may include positioning a balanced piston toe sleeve on a tool string. The balanced piston toe sleeve may include a valve collar. The valve collar may include a valve cylinder formed in a wall of the valve collar. The valve cylinder may be coupled to the bore of the valve collar by a balancing port and a test port. The test port may include a check valve and an output port. The valve collar may include a valve piston positioned within the valve cylinder between the balancing port and the test port. The valve piston may fluidly seal to the valve cylinder and may divide the valve cylinder into a balancing cylinder in fluid communication with the balancing port and an actuating cylinder in fluid communication with the test port. The balanced piston toe sleeve may include a generally tubular mandrel coupled to the valve collar forming a continuous fluidly connected bore. The mandrel may include an aperture from its interior to its exterior. The balanced piston toe sleeve may include a generally tubular port housing coupled to the valve collar. The port housing may define an opening cylinder between an inner wall of the port housing and the exterior cylindrical surface of the mandrel. The opening cylinder may be fluidly coupled to the opening port of the valve collar. The port housing may include an aperture from its interior to the surrounding wellbore positioned to substantially align with the aperture of the mandrel. The balanced piston toe sleeve may include an opening piston positioned to slide within the opening cylinder in response to fluid pressure within the opening cylinder when fluid pressure is introduced therein via the opening port of the valve collar. The opening piston may include at least one piston aperture. The method may further include running the tool string into the wellbore with the valve assembly and the opening piston in the closed positions. The method may further include pressurizing the bore of the tool string in a pressure cycle so that fluid enters the balancing cylinder through the balancing port and the actuating cylinder through the test port via the check valve. The method may further include bleeding the pressure from the bore of the tool string, so that the pressure decreases in the balancing cylinder while the pressure remains in the actuating cylinder. The method may further include traversing the valve piston in the valve cylinder, opening fluid communication between the bore and the output port. The method may further include pressurizing the bore of the tool string. The method may further include flowing fluid through at least a portion of the valve cylinder in fluid communication with the bore and into the output port. The method may further include traversing the opening piston in the opening cylinder.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
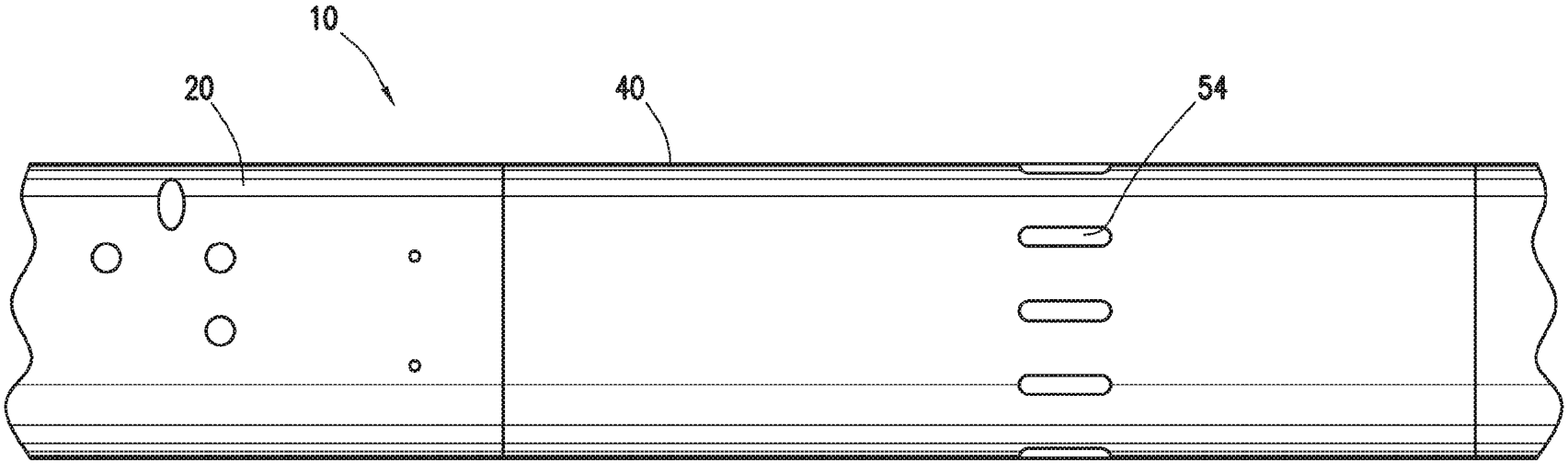
FIG. 1 is an elevation view of a balanced piston toe sleeve consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates a balanced piston toe sleeve 10 consistent with embodiments of this disclosure. Balanced piston toe sleeve 10 may include valve collar 20, and opening assembly 40. Balanced piston toe sleeve 10 may be included as part of a well tubular string (not shown). One having ordinary skill in the art with the benefit of this disclosure will understand that the well tubular string may be a production string, casing string, tubing string, or any other suitable tubular member for use in a wellbore, and may have multiple additional components including, without limitation, tubulars, valves, packers, collars, etc. without deviating from the scope of this disclosure. One having ordinary skill in the art with the benefit of this disclosure will understand that opening assembly 40 as described herein is intended as an example, and any pressure activated tubular opening assembly may be substituted without deviating from the scope of this disclosure. Furthermore, one having ordinary skill in the art with the benefit of this disclosure will understand that opening assembly 40 may be replaced by any pressure actuated downhole tool without deviating from the scope of this disclosure.

Figure 2A:
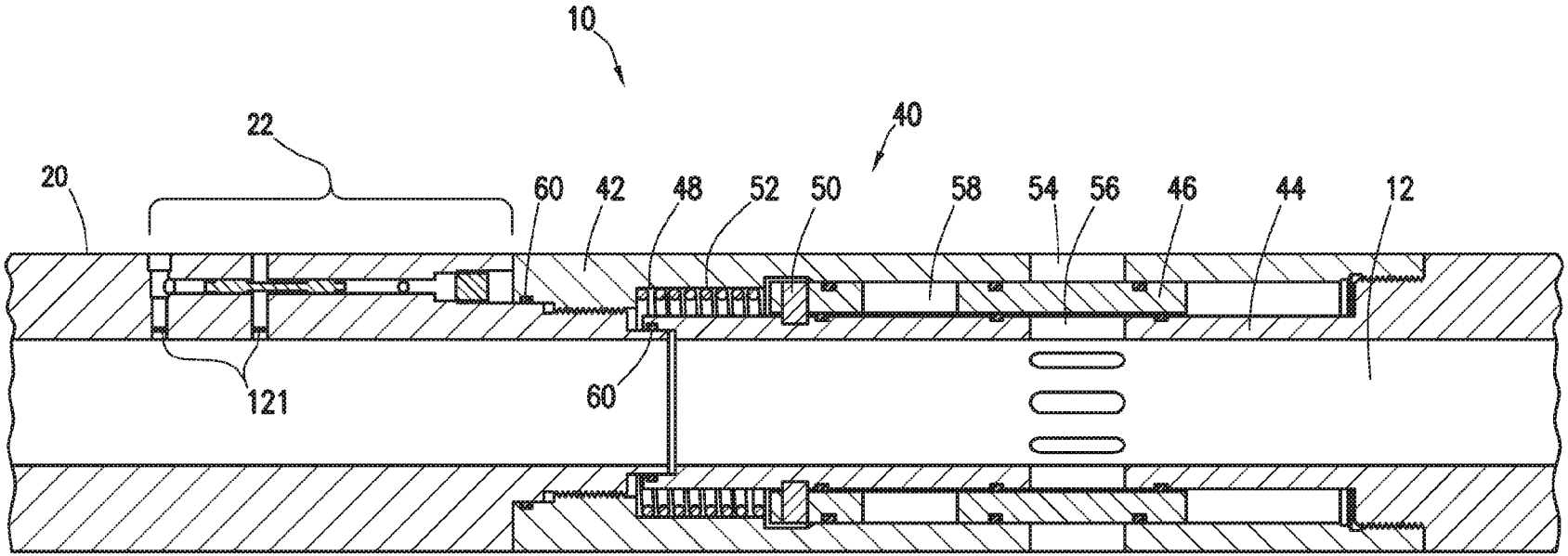
FIG. 2A is a cross section view of the balanced piston toe sleeve of FIG. 1 in a closed position.
Figure 2B:
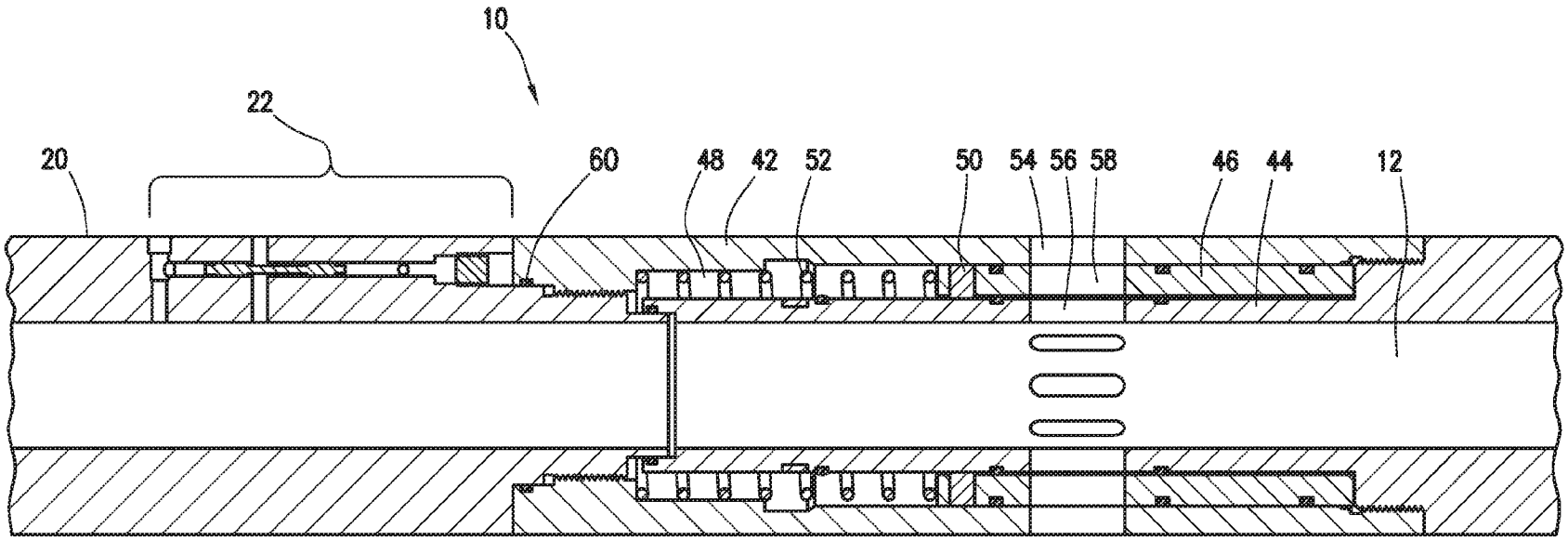
FIG. 2B is a cross section view of the balanced piston toe sleeve of FIG. 1 in an open position.

FIGS. 2A, 2B depict valve collar 20 coupled to opening assembly 40. Opening assembly 40 includes port housing 42, mandrel 44, and opening piston 46. Port housing 42 and mandrel 44 may be coupled to form opening cylinder 48. In certain embodiments, mandrel 44 may be generally tubular. In some embodiments, port housing 42 may be generally tubular. Opening piston 46 is positioned to traverse opening cylinder 48, sliding along an outer surface of mandrel 44 within port housing 42 in response to, for example, an increase in pressure within opening cylinder 48. In some embodiments, at least one retainer, here depicted as shear bolt 50, may be positioned to retain opening piston 46 in the closed position depicted in FIG. 2A until a predefined condition is met, such as until shear bolt 50 is sheared. Shear bolt 50 may be mechanically coupled to port housing 42 or mandrel 44 or both, and may extend at least partially into opening cylinder 48 where it is in contact with opening piston 46. In certain embodiments, spring 52 may be positioned within opening cylinder 48. Spring 52 may bias opening piston 46 into the open position depicted in FIG. 2B once shear bolt 50 is sheared. Spring 52 may also retain opening piston 46 in the open position after a decrease in pressure within the opening cylinder 48.

Port housing 42, mandrel 44, and opening piston 46 each include at least one aperture 54, 56, and 58, respectively. Apertures 54, 56, and 58 may be positioned to align when opening piston 46 is in the open position and thereby allow fluid communication between the bore 12 of balanced piston toe sleeve 10 and the surrounding wellbore (not shown). In certain embodiments, when in the closed position, aperture 58 on opening piston 46 is not aligned with apertures 54 and/or 56 of port housing 42 and mandrel 44, and fluid communication is limited or prevented. Port housing 42, mandrel 44, and opening piston 46 may include one or more seals 60 to, for example, assist with preventing fluid flow when in the closed position, as well as with retaining fluid pressure within opening cylinder 48.

Figure 3A:
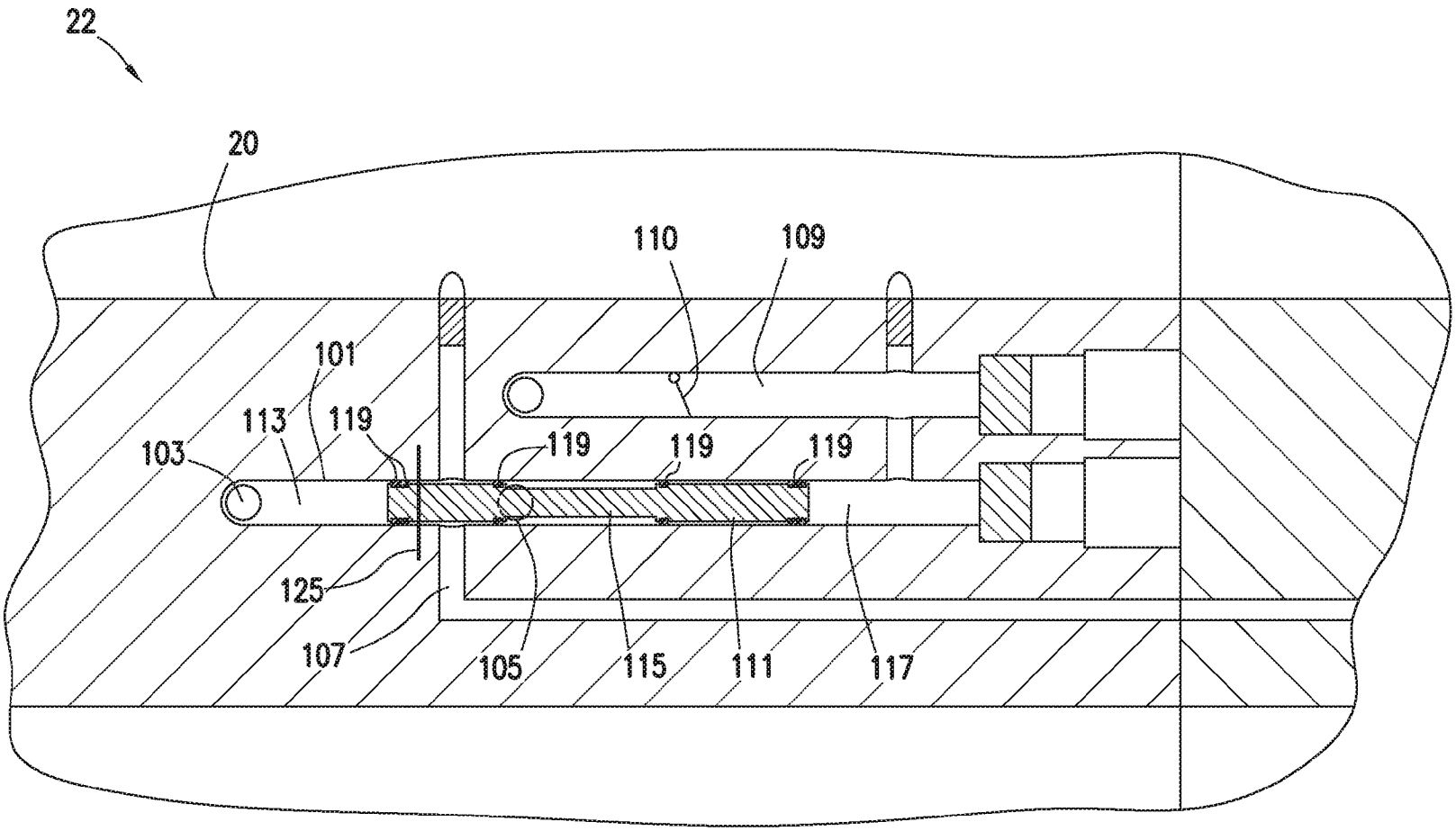
FIG. 3A is a section view of the valve cylinders of a balanced piston toe sleeve consistent with at least one embodiment of the present disclosure in a run-in position.
Figure 3B:
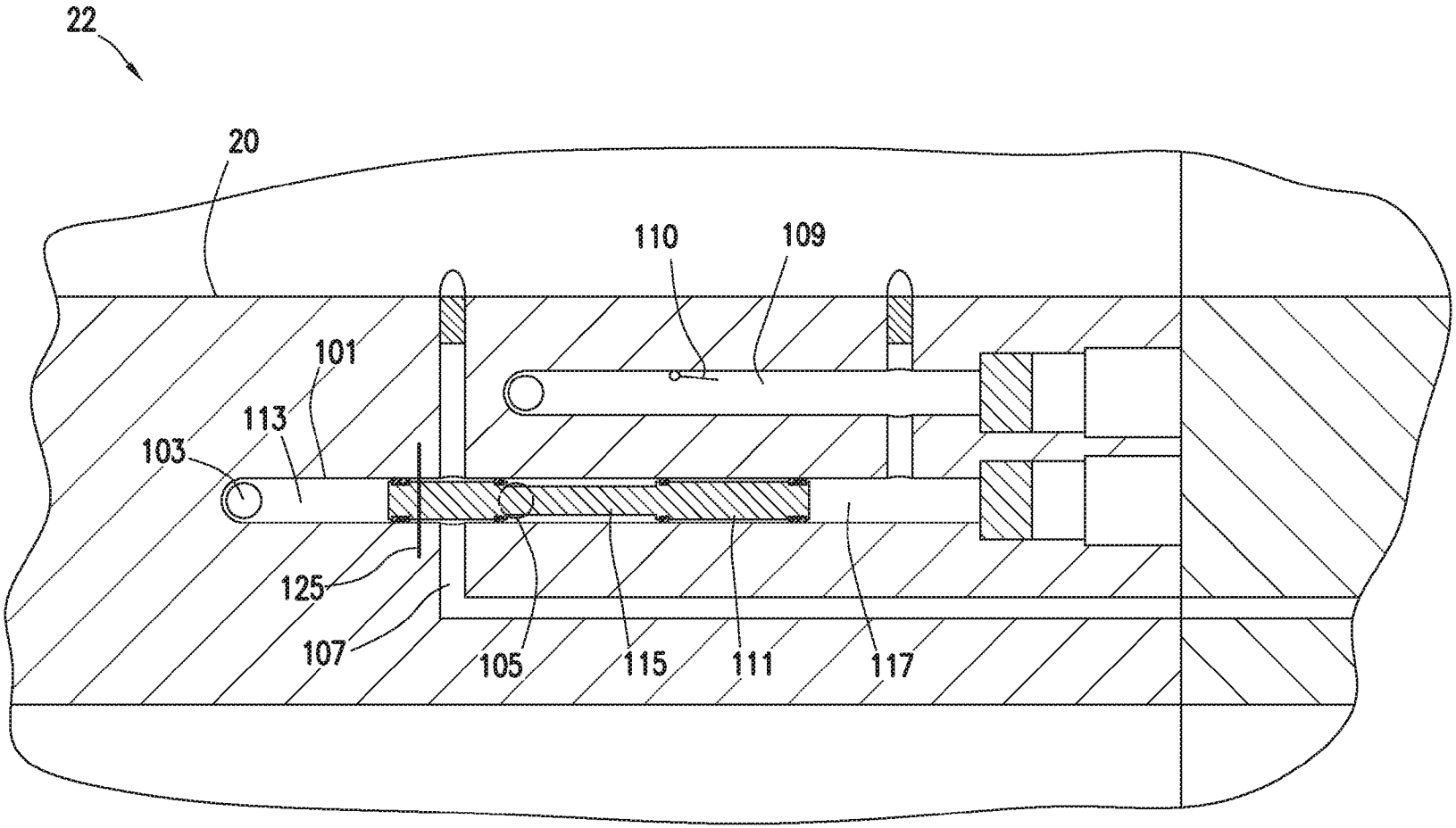
FIG. 3B is a section view of the valve cylinders of FIG. 3A during a test pressurization.
Figure 3C:
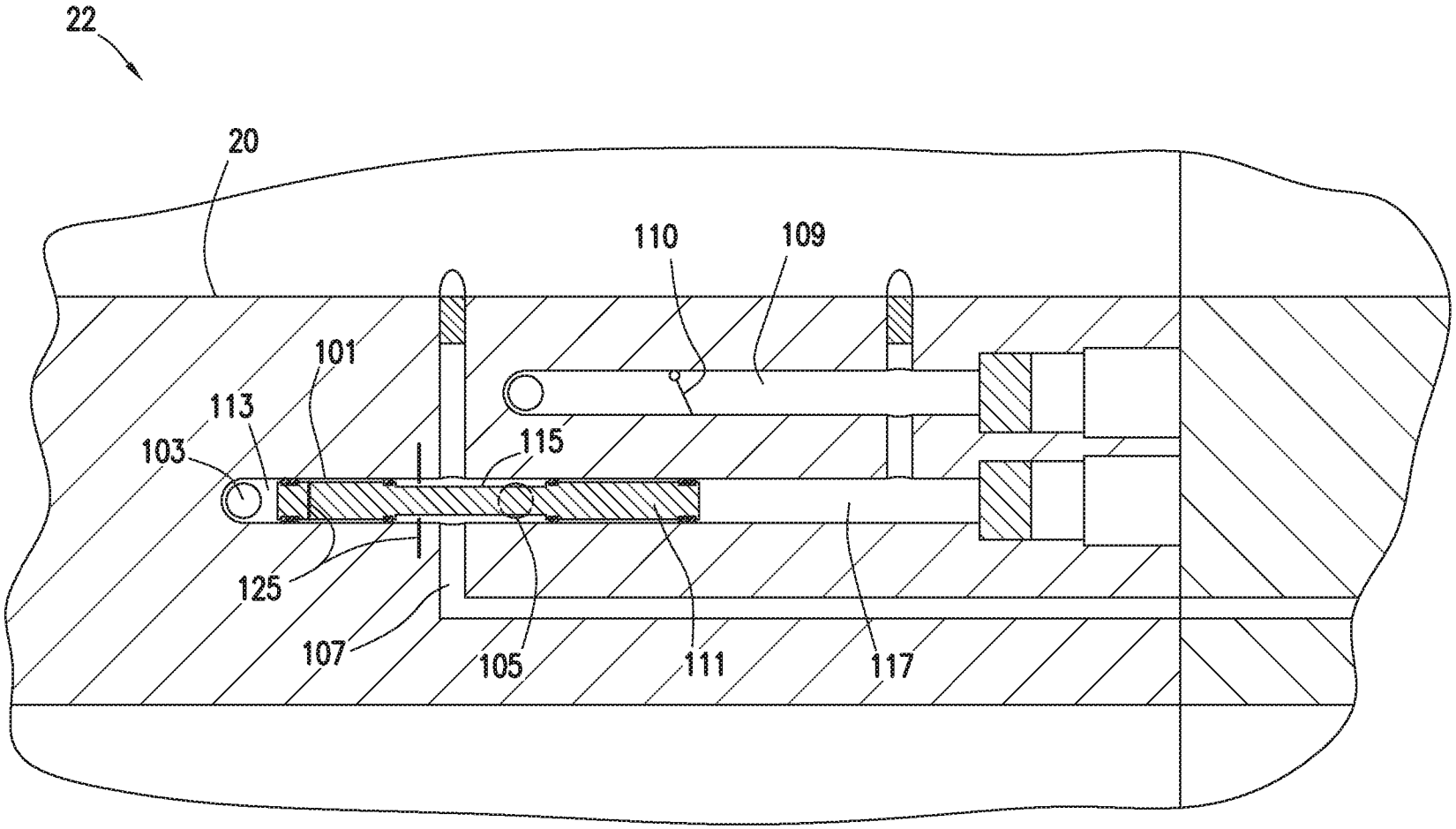
FIG. 3C is a section view of the valve cylinders of FIG. 3A in an open position.

The pressure of the fluid within opening cylinder 48 is controlled by the pressure within bore 12 as controlled by valve assembly 22 within valve collar 20. FIGS. 3A-3C depict a valve assembly 22 consistent with at least one embodiment of the present disclosure. In one embodiment, valve collar 20 includes valve cylinder 101. Valve cylinder 101 may be formed in the wall of valve collar 20. Valve cylinder 101 may be fluidly coupled to bore 12 of valve collar 20 by balancing port 103. In some embodiments, valve cylinder 101 may additionally be fluidly coupled to bore 12 of valve collar 20 by actuating port 105. Valve cylinder 101 may be fluidly coupled to opening cylinder 48 (not shown) via output port 107 formed in valve collar 20 and port housing 42. In some embodiments, a check valve (not shown) may be included between output port 107 and opening cylinder 48 to retard or prevent, for example, fluid from returning through output port 107 from opening cylinder 48.

In some embodiments, valve cylinder 101 may be fluidly coupled to bore 12 of valve collar 20 by test port 109. Test port 109 may include check valve 110. Check valve 110 may, as understood in the art, allow fluid flow in only one direction through test port 109. Here, check valve 110 may allow fluid to flow from bore 12 through test port 109 into valve cylinder 101 while retarding or preventing fluid flow in the reverse. Although depicted as a flapper valve, one having ordinary skill in the art with the benefit of this disclosure will understand that any valve adapted to allow unidirectional flow may be utilized without deviating from the scope of this disclosure.

In some embodiments, valve piston 111 may be positioned within valve cylinder 101. Valve piston 111 may be adapted to fluidly seal to valve cylinder 101. In some embodiments, valve piston 111 may be adapted to separate valve cylinder 101 into balancing cylinder 113 and actuating cylinder 117. In some embodiments, balancing cylinder 113 may be defined as the portion of valve cylinder 101 between balancing port 103 and valve piston 111. In some embodiments, actuating cylinder 117 may be defined as the portion of valve cylinder 101 between test port 109 and valve piston 111.

Valve piston 111 may traverse valve cylinder 101 in response to a pressure imbalance between balancing cylinder 113 and actuating cylinder 117. For example, valve piston 111 may be positioned in the run-in position as depicted in FIGS. 3A, 3B. In some embodiments, valve piston 111 may be retained in the run-in position by shear pin 125. Shear pin 125 may be positioned in the wall of valve collar 20 and may extend at least partially into valve cylinder 101 where it is in contact with valve piston 111. Valve piston 111 may move from the run-in position to an open position as depicted in FIG. 3C when the pressure in actuating cylinder 117 is sufficiently above the pressure in balancing cylinder 113 to cause shear pin 125 to mechanically fail, allowing valve piston 111 to move as discussed further below.

In some embodiments, valve piston 111 may be positioned to prevent fluid flow from valve cylinder 101 to output port 107 when in the run-in position. In some embodiments, valve piston 111 may cover output port 107 when in the run-in position. When in the open position, valve piston 111 may move such that actuating cylinder 117 is in fluid communication with output port 107, fluidly coupling bore 12 with output port 107 via test port 109.

In some embodiments that include actuating port 105 as depicted in FIGS. 3A-3C, actuating port 105 may be positioned such that valve piston 111 blocks fluid flow between actuating port 105 to output port 107 when in the run-in position and fluidly couples actuating port 105 and output port 107 when in the open position. In some embodiments, valve piston 111 may include bypass shank 115, depicted as having a smaller diameter than valve cylinder 101 to, for example and without limitation, create a fluid flow path between actuating port 105 and output port 107. One having ordinary skill in the art with the benefit of this disclosure will understand that the specific structure of valve piston 111 may vary within the scope of this disclosure. Valve piston 111 may include one or more seals 119. One having ordinary skill in the art with the benefit of this disclosure will understand that the geometry of output port 107 may vary within the scope of this disclosure. For example, output port 107 may be formed as an integral fluid flow path within valve piston 111.

In operation, balanced piston toe sleeve 10 may be run into a wellbore as part of a downhole tubular. Balanced piston toe sleeve 10 may be inserted into the wellbore in the closed position, i.e. aperture 58 of opening piston 46 is not aligned with apertures 54, 56 of port housing 42 and mandrel 44 (see FIG. 2A). Likewise, valve piston 111 is retained in the run-in position (FIG. 3A). During a first pressure cycle, such as a pressure test, the bore of the downhole tubular—including bore 12 of hydraulic cycle opening sleeve 10—is fluidly pressurized. As an example, a pressure test may be used to test the integrity of a downhole tubular within the wellbore before high-pressure operations are commenced. Because the opening of hydraulic cycle opening sleeve 10 could compromise the integrity, valve assembly 22 prevents the opening thereof during the pressure test. Because valve piston 111 is in the run-in position, fluid is prevented from entering opening cylinder 48 via output port 107.

During the pressure cycle, fluid may exert pressure on valve piston 111 by flowing into valve cylinder 101. Fluid may enter balancing cylinder 113 through balancing port 103. Fluid may also enter actuating cylinder 117 through test port 109, as check valve 110 allows fluid flow in this direction (FIG. 3B). Fluid may also pass through output port 107, which is blocked from output port 107 by valve piston 111 as previously discussed. Because balancing cylinder 113 and actuating cylinder 117 are both fluidly coupled to bore 12 of hydraulic cycle opening sleeve 10, there may be no differential pressure across valve piston 111. Thus, valve piston 111 may remain in place throughout the entire pressure cycle.

At the completion of the pressure cycle, pressure in bore 12 of balanced piston toe sleeve 10 may be bled off. As the pressure in bore 12 decreases, fluid may exit balancing cylinder 113 through balancing port 103. Fluid in actuating cylinder 117, however, is retarded or prevented from leaving actuating cylinder 117 by check valve 110. Thus, the pressure in balancing cylinder 113 decreases while the pressure in actuating cylinder 117 remains at or near the pressure attained during the pressure cycle. The differential pressure across valve piston 111 causes a resulting force across valve piston 111 in the direction of balancing cylinder 113. Once the resulting force is sufficient, shear pin 125 may mechanically fail, allowing valve piston 111 to move from the run-in position to the open position as depicted in FIG. 3C.

During a subsequent pressurization of bore 12, the pressure in actuating cylinder 117 remains, retarding or preventing valve piston 111 from moving from the open position. Alternatively, in embodiments which do not include actuating port 105, the pressure in actuating cylinder 117 and in balancing cylinder 113 remains equal or about equal as both are open to the pressure from bore 12. With valve piston 111 in the open position, fluid pressure from bore 12 may act on opening piston 46 via test port 109 or actuating port 105 and output port 107. With regard to FIG. 2A, when sufficient force has been exerted on shear bolt 50, shear bolt 50 will shear. Opening piston 46 may then traverse opening cylinder 48, and opening piston 46 may move into the open position shown in FIG. 2B. Fluid communication is thereby established between bore 12 and the surrounding wellbore. In some embodiments, spring 52 may bias opening piston 46 into the open position.

Figure 4:
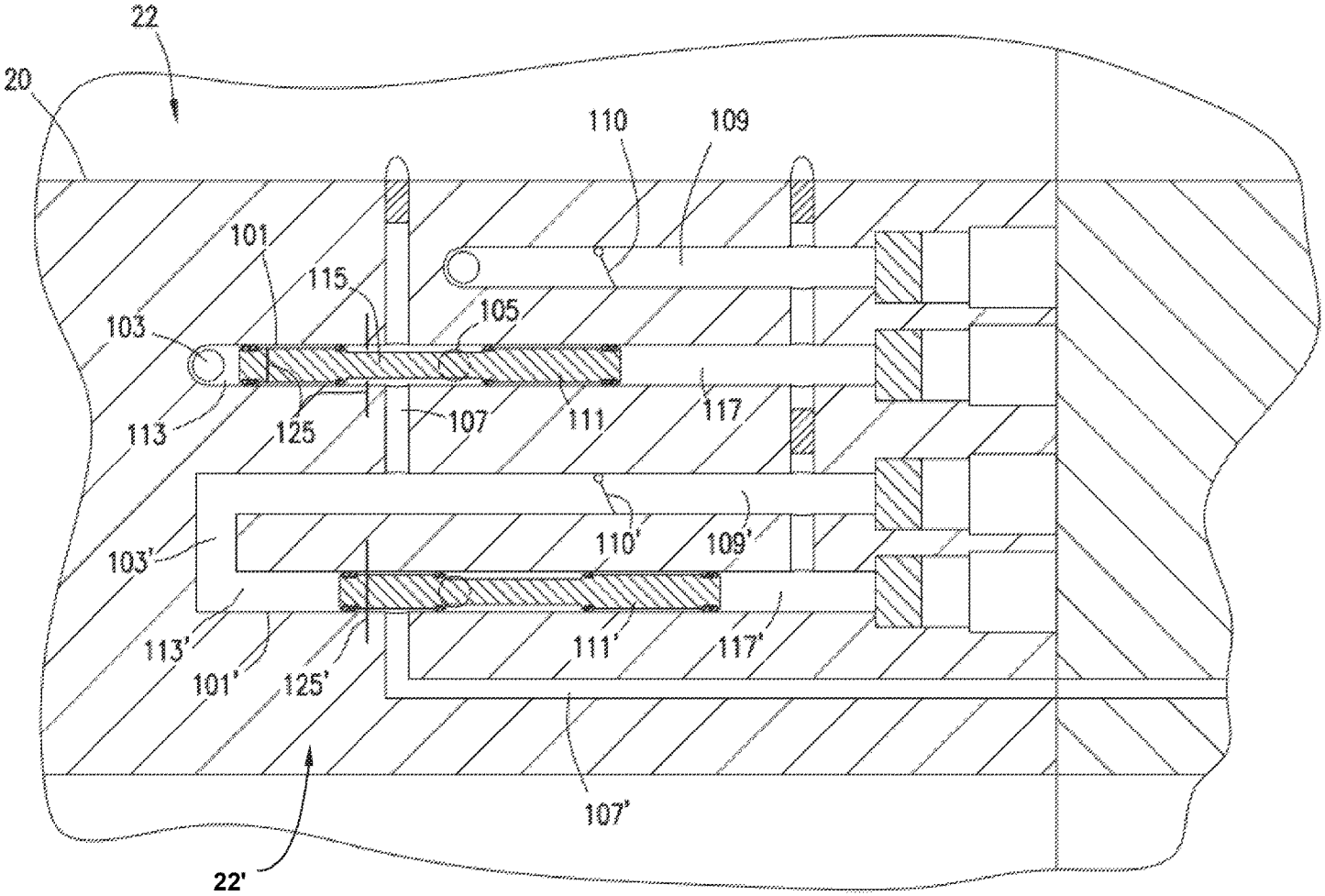
FIG. 4 is a section view of the valve cylinders of a balanced piston toe sleeve consistent with at least one embodiment of the present disclosure.

In some embodiments of the present disclosure, secondary valve assembly 22' may be included in valve collar 20 as depicted in FIG. 4 allowing for, for example, more than one pressure cycle to be carried out before actuating opening assembly 40 of balanced piston toe sleeve 10. Secondary valve assembly 22' may be coupled to valve assembly 22 through output port 107 of valve assembly 22, and may operate in the same manner as valve assembly 22, with output port 107 supplying fluid to balancing port 103' of secondary valve assembly 22'. Output port 107' of secondary valve assembly 22' may be connected to opening cylinder 48 (not shown). FIG. 4 depicts valve assembly 22 in the open position and secondary valve assembly 22' in the closed position. One having ordinary skill in the art with the benefit of this disclosure will likewise understand that the layout of the valve assembly 22 and secondary valve assembly 22' and the port configuration therebetween may be other than depicted without deviating from the scope of this disclosure.

As depicted in FIG. 4, a first pressure cycle has occurred and pressure has been bled. Valve assembly 22 is therefore in the open position, thereby opening fluid communication between bore 12 of balanced piston toe sleeve 10 to balancing port 103' and test port 109' of valve chamber 101' of secondary valve assembly 22' via actuating port 105, valve chamber 101, output port 107, and actuating port 103'. Secondary valve assembly 22' is still in the run in configuration. Therefore, a second pressure cycle is possible before balanced piston toe sleeve 10 will be opened.

One having ordinary skill in the art with the benefit of this disclosure will understand that any number of valve assemblies, given the physical constraints of the valve collar 20, may be included in valve collar 20 in such an arrangement to increase the number of test pressure cycles available before opening piston 46 is actuated.

In some embodiments, as depicted in FIG. 2A, one or more burst disks 121 may be positioned at one or more of balancing port 103, actuating port 105, and test port 109 (not shown). Burst disks 121 may, as understood in the art, mechanically fail at a selected differential pressure between bore 12 and valve assembly 20. Burst disks 121 may, for example and without limitation, prevent debris or cement from entering valve assembly 20 during run in operations. One having ordinary skill in the art with the benefit of this disclosure will understand that balanced piston toe sleeve 10 need not rely on burst disk 121 or any other pressure detection or metering mechanisms during operation.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A valve assembly for a pressure-actuated downhole tool comprising:

a valve collar, the valve collar having a bore therethrough and including:

a valve cylinder formed in a wall of the valve collar, the valve cylinder coupled to the bore of the valve collar by a balancing port and a test port, the test port including a check valve;

a valve piston positioned within the valve cylinder between the balancing port and the test port, the valve piston fluidly sealing to the valve cylinder and dividing the valve cylinder into a balancing cylinder in fluid communication with the balancing port and an actuating cylinder in fluid communication with the test port, the valve piston being moveable between a closed position and an open position; and an output port, fluid flow being prevented between the output port and the valve cylinder when the valve piston is in the closed position and fluid flow being allowed between the output port and the valve cylinder when the valve piston is in the open position;

wherein when the valve piston is in the open position the test port is in fluid communication with the output port.

2. The valve assembly of claim 1, wherein the valve collar further comprises an actuation port in fluid communication with the bore and wherein when the valve piston is in the open position the actuation port is in fluid communication with the output port.

3. The valve assembly of claim 1, further comprising a shear pin positioned in the wall of the valve collar and extending into the valve cylinder and in contact with the valve piston.

4. The valve assembly of claim 1, wherein the output port is fluidly coupled to the pressure-actuated tool.

5. The valve assembly of claim 1, further comprising a burst disk positioned in one or more of the balancing port and the test port.

6. The valve assembly of claim 1, wherein the valve collar further comprises:

a secondary valve cylinder formed in the wall of the valve collar, the secondary valve cylinder coupled to the output port by a secondary balancing port and a secondary test port, the secondary test port including a secondary check valve;

a secondary valve piston positioned within the secondary valve cylinder between the secondary balancing port and the secondary test port, the secondary valve piston fluidly sealing to the secondary valve cylinder and dividing the secondary valve cylinder into a secondary balancing cylinder in fluid communication with the secondary balancing port and a secondary actuating cylinder in fluid communication with the secondary test port, the secondary valve piston being moveable between a closed position and an open position; and a secondary output port, fluid flow being prevented between the output port and the secondary valve cylinder when the secondary valve piston is in the closed position and fluid flow being allowed between the output port and the secondary actuating cylinder when the secondary valve piston is in the open position.

7. A balanced piston toe sleeve comprising:

a valve collar, the valve collar having a bore therethrough and including:

a valve cylinder formed in a wall of the valve collar, the valve cylinder coupled to the bore of the valve collar by a balancing port and a test port, the test port including a check valve;

a valve piston positioned within the valve cylinder between the balancing port and the test port, the valve piston fluidly sealing to the valve cylinder and dividing the valve cylinder into a balancing cylinder in fluid communication with the balancing port and an actuating cylinder in fluid communication with the test port, the valve piston being moveable between a closed position and an open position; and an output port, fluid flow being prevented between the output port and the valve cylinder when the valve piston is in the closed position and fluid flow being allowed between the output port and the valve cylinder when the valve piston is in the open position;

wherein when the valve piston is in the open position the test port is in fluid communication with the output port;

a generally tubular mandrel having a bore therethrough and an exterior, the mandrel being coupled to the valve collar and forming a continuous fluidly connected bore therewith, the mandrel including an aperture from the mandrel bore to the mandrel exterior;

a generally tubular port housing having an interior and an exterior, the port housing being coupled to the valve collar, the port housing defining an opening cylinder between an inner wall of the port housing and the exterior of the mandrel, the opening cylinder fluidly coupled to the output port of the valve collar, the port housing including an aperture from the interior of the port housing to the surrounding wellbore positioned to substantially align with the aperture of the mandrel;

an opening piston, the opening piston positioned to slide within the opening cylinder in response to fluid pressure within the opening cylinder when fluid pressure is introduced therein via the output port of the valve collar, the opening piston including at least one piston aperture.

8. The balanced piston toe sleeve of claim 7, further comprising a shear bolt mechanically coupled to one or both of the mandrel or port housing, the shear bolt extending at least partially into the opening cylinder and in contact with the opening piston.

9. The balanced piston toe sleeve of claim 8, further comprising an opening spring positioned to bias the opening piston into an open position once the shear bolt is sheared, and maintain the opening piston in the open position when pressure within the opening cylinder is bled.

10. The balanced piston toe sleeve of claim 7, wherein the valve collar further comprises an actuation port in fluid communication with the bore and wherein the valve piston is repositioned within the valve cylinder such that the actuation port is in fluid communication with the output port.

11. The balanced piston toe sleeve of claim 7, further comprising a shear pin positioned in the wall of the valve collar and extending into the valve cylinder and in contact with the valve piston.

12. The balanced piston toe sleeve of claim 7, further comprising a burst disk positioned in one or more of the balancing port and the test port.

13. The balanced piston toe sleeve of claim 7 wherein the valve collar further comprises:

a secondary valve cylinder formed in the wall of the valve collar, the secondary valve cylinder coupled to the output port by a secondary balancing port and a secondary test port, the secondary test port including a secondary check valve;

a secondary valve piston positioned within the secondary valve cylinder between the secondary balancing port and the secondary test port, the secondary valve piston fluidly sealing to the secondary valve cylinder and dividing the secondary valve cylinder into a secondary balancing cylinder in fluid communication with the secondary balancing port and a secondary actuating cylinder in fluid communication with the secondary test port, the secondary valve piston being moveable between a closed position and an open position; and a secondary output port, fluid flow being prevented between the output port and the secondary actuating cylinder when the secondary valve piston is in the closed position and fluid flow being allowed between the output port and the secondary actuating cylinder when the secondary valve piston is in the open position.

14. A method comprising:

positioning a balanced piston toe sleeve on a tool string, the balanced piston toe sleeve including:

a valve collar, the valve collar having a bore therethrough and including:

a valve cylinder formed in a wall of the valve collar, the valve cylinder coupled to the bore of the valve collar by a balancing port and a test port, the test port including a check valve;

a valve piston positioned within the valve cylinder between the balancing port and the test port, the valve piston fluidly sealing to the valve cylinder and dividing the valve cylinder into a balancing cylinder in fluid communication with the balancing port and an actuating cylinder in fluid communication with the test port the valve piston being moveable between a closed position and an open position; and an output port, fluid flow being prevented between the output port and the valve cylinder when the valve piston is in the closed position and fluid flow being allowed between the output port and the valve cylinder when the valve piston is in the open position;

wherein when the valve piston is in the open position the test port is in fluid communication with the output port;

a generally tubular mandrel having an interior and an exterior, the mandrel being coupled to the valve collar forming a continuous fluidly connected bore therewith, the mandrel including an aperture from the interior of the mandrel to the exterior of the mandrel;

a generally tubular port housing having an interior and an exterior, the port housing being coupled to the valve collar, the port housing defining an opening cylinder between an inner wall of the port housing and the exterior of the mandrel, the opening cylinder fluidly coupled to the output port of the valve collar, the port housing including an aperture from the interior of the port housing to the surrounding wellbore positioned to substantially align with the aperture of the mandrel;

an opening piston positioned to slide about the mandrel, the opening piston positioned to slide within the opening cylinder in response to fluid pressure within the opening cylinder when fluid pressure is introduced therein via the output port of the valve collar, the opening piston including at least one piston aperture;

running the tool string into the wellbore with the valve piston and the opening piston in the closed positions;

pressurizing the bore of the tool string in a pressure cycle so that fluid enters the balancing cylinder through the balancing port and the actuating cylinder through the test port via the check valve;

bleeding the pressure from the bore of the tool string, so that the pressure decreases in the balancing cylinder while the pressure remains in the actuating cylinder;

allowing the valve piston to move in the valve cylinder from the closed position to the open position, thereby opening fluid communication between the bore and the output port; and flowing fluid through at least a portion of the valve cylinder in fluid communication with the bore and into the output port; and allowing the opening piston to move to an open position in the opening cylinder.

15. The method of claim 14, wherein the balanced piston toe sleeve further comprises a shear bolt mechanically coupled to one or both of the mandrel or the port housing, the shear bolt extending at least partially into the opening cylinder and in contact with the opening piston, and the method further comprises shearing the shear bolt.

16. The method of claim 14, wherein the balanced piston toe sleeve further comprises a shear pin positioned in the wall of the valve collar and extending into the valve cylinder and in contact with the valve piston, and the method further comprises shearing the shear pin.

17. The method of claim 14, wherein the balanced piston toe sleeve further comprises:

a secondary valve cylinder formed in the wall of the valve collar, the secondary valve cylinder coupled to the output port by a secondary balancing port and a secondary test port, the secondary test port including a secondary check valve;

a secondary valve piston positioned within the secondary valve cylinder between the secondary balancing port and the secondary test port, the secondary valve piston fluidly sealing to the secondary valve cylinder and dividing the secondary valve cylinder into a secondary balancing cylinder in fluid communication with the secondary balancing port and a secondary actuating cylinder in fluid communication with the secondary test port, the secondary valve piston being moveable between a closed position and an open position; and a secondary output port, fluid flow being prevented between the output port and the secondary valve cylinder when the secondary valve piston is in the closed position and fluid flow being allowed between the output port an the secondary valve cylinder when the secondary valve piston is in the open position;

the method further comprising:

allowing the secondary valve piston to move in the valve cylinder from the closed position to the open position, thereby opening fluid communication between the bore and the secondary output port.

18. The method of claim 15, further comprising an opening spring positioned to bias the opening piston into an open position once the shear bolt is sheared and maintain the opening piston in the open position when pressure within the opening cylinder is bled.

* * * * *